United States Patent [19]

McCoy et al.

[11] 4,285,536

[45] Aug. 25, 1981

[54] UNIVERSAL LEVER HANDLE ATTACHMENT FOR DOOR KNOB

[75] Inventors: French T. McCoy; Thomas A. Steinbrunner; Dale L. McEvers; Loyal M. Overholser, all of Dayton, Ohio

[73] Assignee: TLM Industries, Inc., Dayton, Ohio

[21] Appl. No.: 96,882

[22] Filed: Nov. 23, 1979

[51] Int. Cl.[3] ..... E05C 13/00

[52] U.S. Cl. ..... 292/336.3; 292/DIG. 2

[58] Field of Search ..... 292/336.3, 347, 244, 292/DIG. 2

[56] References Cited

U.S. PATENT DOCUMENTS

| | | | |
|---|---|---|---|
| 2,756,088 | 7/1956 | Sutter | 292/DIG. 2 X |
| 2,808,282 | 10/1957 | Peoples | 292/347 |
| 2,967,593 | 1/1961 | Cushman | 85/50 R |
| 3,306,643 | 2/1967 | Reed | 292/347 |
| 3,306,643 | 2/1967 | Reed | 292/347 |
| 3,575,453 | 4/1971 | Hohl | 292/336.3 |
| 3,827,739 | 8/1974 | Overholser | 292/DIG. 2 X |
| 4,018,465 | 4/1977 | Ramler | 292/336.3 |

*Primary Examiner*—Richard E. Moore

*Attorney, Agent, or Firm*—Witherspoon & Hargest

[57] ABSTRACT

A universal lever handle attachment for a door knob wherein a knob engaging and gripping portion is adapted to fit over a door knob, an intermediate portion is connected to the knob engaging portion and is configured to operatively receive a universal screw adjusting assembly which tightens the knob engaging portion onto the door knob and a handle portion extending outwardly from the intermediate portion. The universal screw means is operatively arranged to cooperate with the intermediate portion to provide for right or left hand installation.

5 Claims, 3 Drawing Figures

UNIVERSAL LEVER HANDLE ATTACHMENT FOR DOOR KNOB

BACKGROUND OF THE INVENTION

The conventional door knob is a well accepted part of society in that it is used to operate latch mechanisms of various types used in all types of closures. The most used door knob is one which is rotated to revolve the latch mechanism and allow the door to be opened. To most people this is a procedure that is followed with little or no thought, on the other hand, there are a large number of people who, for various reasons, cannot grip and rotate a door knob. Further, there are various types of work wherein a door must be opened while both hands of the operator are otherwise employed. Thus there is a definite and apparent need for means attachable to a door knob to make it possible to rotate it without gripping the knob and with the exertion of only a minimal amount of force.

This problem and solution therefor appear in the prior patented art, for example Overholser U.S. Pat. No. 3,827,739 is directed to a lever attachment for door knobs wherein a cylindrical portion grips the knob and has a handle extending therefrom to provide the requisite ratio for easy rotation of the knob. Hohl U.S. Pat. No. 3,575,453 discloses an easy door opener comprising a door knob grip section in the form of a resilient curved element with a handle extending therefrom. Sutter U.S. Pat. No. 2,756,088 relates to door knob extension handles wherein a concave portion fits around a door knob and has a handle extending therefrom.

Thus the broad concept of a door knob gripping member with a lever attached thereto is well known in the prior art. Generally, most assemblies for assisting in the operation of a door knob are made for right or left handed use. It is therefor an object of this invention to provide an attachment for a door knob which is well known in the prior art. Generally, most assemblies for assisting in the operation of a door knob are made for right or left handed use. It is therefore an object of this invention to provide an attachment for a door knob which is universal in use.

It is a further object of this invention to provide a universal attachment for a door knob which is basically a unitary device having the requisite adjustability to be usable on a variety of door knob sizes.

It is another object of this invention to provide the door knob attachment as set forth in the preceding objects and wherein a universal screw adjusting assembly is provided for causing the handle portion of the attachment to firmly grip the knob.

The above and other objects and advantages will become more apparent when taken in conjunction with the following detailed description and drawings.

DETAILED DESCRIPTION OF THE INVENTION

Figure 2:
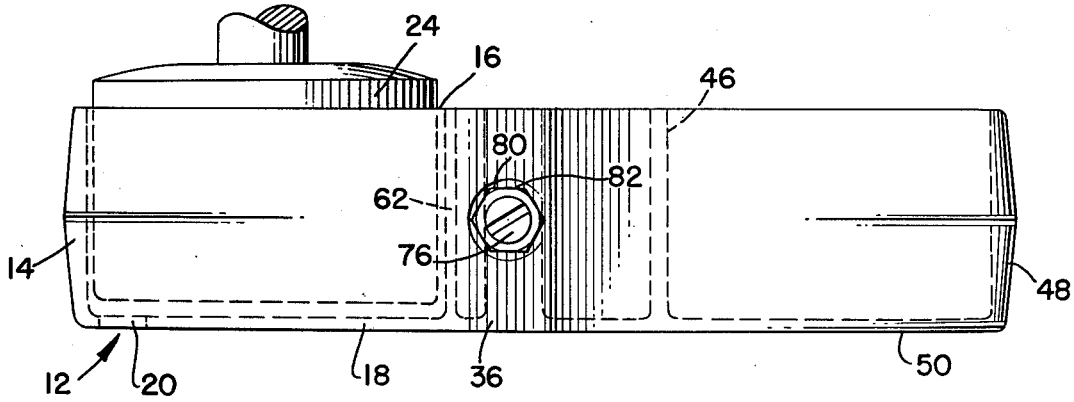
FIG. 2 is a horizontal plan view of the arrangement illustrated in FIG. 1.

As shown in the three figures of the drawing, the universal lever handle attachment 10 comprises a knob engaging and gripping portion 12 including a cylindrical head portion 14 having a completely open end 16 with the other end 18 being partly closed by means of a universally extending flange 20 provided with radially inwardly extending relief slots 22. The inner diameter of the cylindrical head 14 is slightly greater than the door knob 24 which it is adapted to receive as illustrated in FIG. 2.

A body portion 30 extends from the cylindrical head portion 14 and comprises gently inwardly curved web portion 32 and 34 extending from the cylindrical head portion 14. The web portions 32 and 34 are supported by transverse connecting portion 36.

The web portion 32 and 34 merge with web portions 40 and 42 to form a handle 44 and are connected by transverse connecting portion 46 and an end closing portion 48. The outward or face side of the handle 44 is closed off by planar portion 50 to form a smooth surface coplanar with the outer surface of transverse portion 36.

In order to provide adjustability of the cylindrical head 14 a relief slot 60 is cut axially through the cylindrical wall 62 of the cylindrical head 14 and correspondingly through the transverse connecting portion 36 of the body portion 30 with the slot 60 terminating at the transverse connecting portion 46.

Hexagonal openings 68 and 70 are formed in the body portion 36 perpendicular to the slot 60 and on each side thereof. These openings 68 and 70 are connected by through hole 72. A universal screw adjusting assembly is operatively mounted in the two hexagonal holes 68 and 70 and connecting through hole 72. The universal screw adjusting assembly comprises a threaded screw 74 having a generally flat slotted head 76 tapering downwardly and inwardly from its periphery to the threaded screw body 78. The screw head 76 fits in a washer 80 having an hexagonal outer configuration 82 sized to fit snugly into hexagonal opening 68 or 70 depending on the installation of the attachment 10. The washer 80 is provided with a sloping inner surface 84 corresponding to a cooperating surface on the screw head 74. A nut 86 having an hexagonal outer face 88 is threadably mounted on the free end of the screw body 78.

Figure 1:
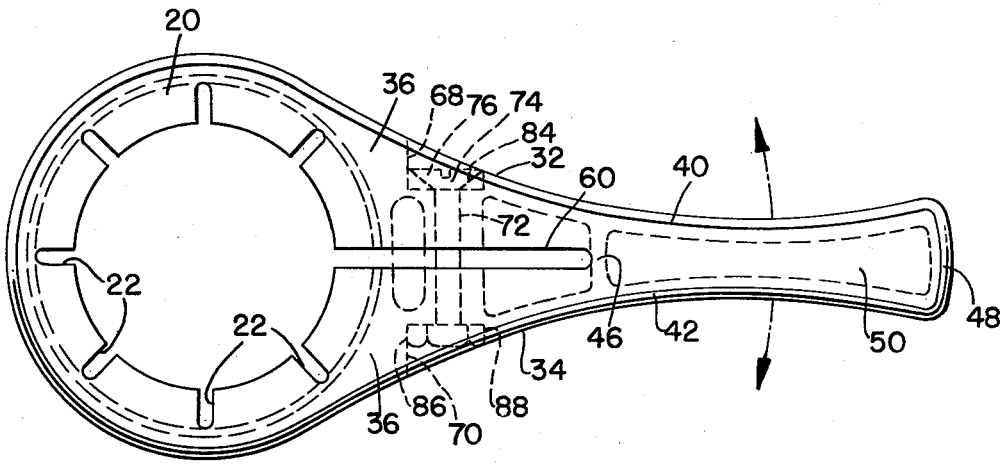
FIG. 1 is an elevational view showing the universal lever handle attachment mounted on a door knob for right-handed use.
Figure 3:
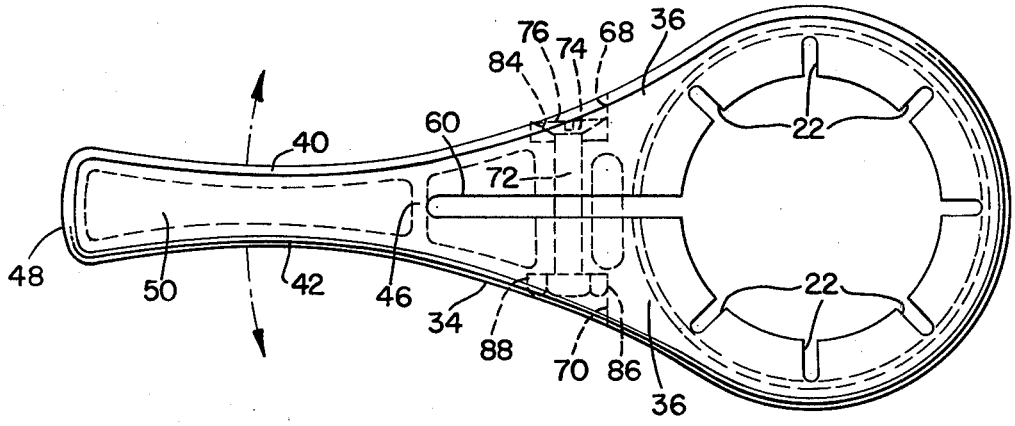
FIG. 3 is an elevational view showing the universal lever handle attachment mounted on a door knob for left-handed use.

In order to maximize ease of installation of the attachment 10 on a door knob 24, the universal screw adjusting assembly is completely reversible in the body portion so that the slotted head 76 is always facing upwardly. For example, for right hand installation as illustrated in FIG. 1 the screw head 76 is facing upward while in the left hand installation as shown in FIG. 3 the universal screw adjusting assembly has been reversed so that the slotted screw head 76 is facing upward.

The installation and operation of the attachment 10 should now be reasonably clear, even so a brief explanation follows. With the attachment 10 assembled in the manner illustrated in FIG. 1, the head 14 is slipped over the door knob 24 and squarely fitted within the head 14. Next the screw 74 is tightened so that the inner surface of the cylindrical head 14 will engage and grip the door head 24. The present attachment 10 may be secured at any angle throughout a complete revolution and still function in the designed manner, thus providing the maximum in universality.

There may be times when the spacing between the door knob and the inner surface of the cylindrical knob 14 is such that a shim or bushing is required dur to limitations in the amount of adjustability residing in the cylindrical head 14. Such an arrangement is well known in the prior art and is clearly shown in FIGS. 3 and 4 of the U.S. Pat. No. 3,827,739.

In view of the foregoing it should now be apparent that the universal lever handle attachment for door knobs constitutes an advance in the art and is worthy of protection by issuing of a patent.

What is claimed is:

1. A universal lever handle attachment for a door knob said attachment comprising, a knob engaging and gripping portion including a cylindrical head portion having a diameter closely approximating that of the knob which it is adapted to fit over the grip, relief means formed in the cylindrical head portion to provide adjustability of effective diameter of the cylindrical head portion, an intermediate portion connected to the knob engaging and gripping portion, said intermediate portion being configured to operatively receive a universal screw adjusting assembly, said universal screw adjusting assembly including an adjusting screw having a slotted head, said head being tapered downwardly from its outer periphery to the screw body extending therefrom, a washer fitting up against the underside of the screw head and having its contacting face correspondingly tapered with respect to the underside of the screw head, and a nut threadably engaging the end portion of the screw body, the aforesaid relief means in the cylindrical head portion extending into the intermediate portion connected to the knob engaging and gripping portion, the intermediate portion being provided with opposed openings spanning the relief means in the intermediate portion whereby the universal screw adjusting assembly is mounted with the washer in one opening and the nut in the other, and a handle portion extending from the intermediate portion, said handle portion being symmetrical so that it may be conveniently operated from the right or left side of the door knob.

2. The invention as set forth in claim 1 and wherein the cylindrical head portion has an inwardly directed flange at one end thereof to assist in positioning the attachment on the door knob.

3. The invention as set forth in claim 2 and wherein the flange has radially directed slots to act as additional relief means in the cylindrical head portion.

4. The invention as set forth in claim 1 and wherein the opposed openings are polygonally sloped in cross section and the washer and screw head are conformingly shaped to the opposed openings.

5. The invention as set forth in claim 4 and wherein the polygonally shaped openings are hexagonal.

* * * * *